US009743473B2

(12) United States Patent
Weaver

(10) Patent No.: US 9,743,473 B2
(45) Date of Patent: Aug. 22, 2017

(54) CASCADE LED DRIVER AND CONTROL METHODS

(71) Applicant: Lumenetix, Inc., Scotts Valley, CA (US)

(72) Inventor: Matthew D. Weaver, Aptos, CA (US)

(73) Assignee: LUMENETIX, INC., Scotts Valley, CA (US)

( * ) Notice: Subject to any disclaimer, the term of this patent is extended or adjusted under 35 U.S.C. 154(b) by 598 days.

(21) Appl. No.: 13/815,897

(22) Filed: Mar. 15, 2013

(65) Prior Publication Data

US 2014/0265894 A1 Sep. 18, 2014

(51) Int. Cl.
*H05B 33/08* (2006.01)

(52) U.S. Cl.
CPC ..... *H05B 33/083* (2013.01)

(58) Field of Classification Search
CPC .... H05B 37/02; H05B 33/08; H05B 33/0887; H05B 33/0812; H05B 33/0815; H05B 33/0824; H05B 33/0827
USPC ..... 315/185 R, 186, 193, 291, 307, 308
See application file for complete search history.

(56) References Cited

U.S. PATENT DOCUMENTS 4,774,454 A * 9/1988 Yamaguchi ..... G01R 23/16 324/623
6,153,980 A 11/2000 Marshall et al.
7,046,738 B1 * 5/2006 Dent ..... H04L 25/03834 332/103
7,317,403 B2 1/2008 Grootes et al.
7,425,943 B2 9/2008 Furukawa
7,468,723 B1 12/2008 Collins
7,649,326 B2 1/2010 Johnson et al.
7,663,598 B2 2/2010 Kim
7,688,002 B2 3/2010 Ashdown et al.
7,986,107 B2 7/2011 Weaver et al.
8,531,128 B2 9/2013 Weaver et al.
8,896,220 B2 * 11/2014 Moskowitz ..... H05B 33/083 315/185 R
8,917,026 B2 12/2014 Ferrier
2007/0257623 A1 11/2007 Johnson et al.
2008/0122376 A1 5/2008 Lys
2008/0191642 A1 8/2008 Slot et al.
2008/0303452 A1 12/2008 Van Erp
2009/0085489 A1 4/2009 Chang et al.
2010/0194274 A1 8/2010 Hoogzaad
(Continued)

FOREIGN PATENT DOCUMENTS

JP 2001051638 A 2/2001
JP 2004235046 A 8/2004
(Continued)

OTHER PUBLICATIONS

Co-Pending U.S. Appl. No. 12/370,545 by Weaver, et al., filed Feb. 12, 2009.

(Continued)

*Primary Examiner* — Thai Pham
(74) *Attorney, Agent, or Firm* — Perkins Coie LLP

(57) ABSTRACT

An electrical circuit is disclosed and methods for controlling the same. The electrical circuit may comprises a plurality of color strings coupled in series, where each color string has at least one lamp, preferably a light emitting diode. Improved efficiency may be accomplished in some embodiments using certain of the disclosed systems and methods.

9 Claims, 11 Drawing Sheets

(56) References Cited

U.S. PATENT DOCUMENTS

| | | | | |
|---|---|---|---|---|
| 2011/0309757 | A1 | 12/2011 | Weaver et al. | |
| 2013/0121042 | A1* | 5/2013 | Gan | H02M 7/49 363/37 |
| 2013/0207559 | A1 | 8/2013 | Ferrier et al. | |

FOREIGN PATENT DOCUMENTS

| | | | |
|---|---|---|---|
| JP | 2005310997 | A | 11/2005 |
| WO | WO-2006/107199 | | 10/2006 |
| WO | WO-2008/139365 | A1 | 11/2008 |

OTHER PUBLICATIONS

Co-Pending U.S. Appl. No. 13/162,501 by Weaver, et al., filed Jun. 16, 2011.
Co-Pending U.S. Appl. No. 13/717,594 by Ferrier, et al., filed Dec. 17, 2012.
Co-Pending U.S. Appl. No. 13/892,171 by Weaver, et al., filed May 10, 2013.
International Search Report and Written Opinion mailed May 28, 2009, for International Patent Application No. PCT/US09/001254 filed Feb. 27, 2009, pp. 1-10.
Non-Final Office Action mailed Dec. 8, 2010, in Co-Pending U.S. Appl. No. 12/370,545 of Weaver et al., filed Feb. 12, 2009.
Non-Final Office Action mailed Feb. 26, 2014, in Co-Pending U.S. Appl. No. 13/717,594, of Weaver et al., filed Dec. 17, 2012, 12 pages.
Non-Final Office Action mailed May 11, 2012, in Co-Pending U.S. Appl. No. 13/162,501, of Weaver et al., filed Jun. 16, 2011, 8 pages.
Notice of Allowance, mailed Mar. 21, 2011, in Co-Pending U.S. Appl. No. 12/370,545 of Weaver et al., filed Feb. 12, 2009,4 pages.
Notice of Allowance, mailed May 15, 2013, in Co-Pending U.S. Appl. No. 13/162,501, of Weaver et al., filed Jun. 16, 2011, 6 pages.
Notice of Allowance mailed Aug. 19, 2014, in U.S. Appl. No. 13/717,594, of Weaver et al., filed Dec. 17, 2012.

* cited by examiner

800

```
short int H, acc;

H=27000;
acc = H;
for(i=0;i<65536;++i)
{
        if(acc & 0x8000)
        {
                ++offtime;    //sign bit set
                printf(" ");
        }
        else
        {
                ++ontime;
                printf("*");
        }
        acc |= 0x8000;  //set sign bit every time
        acc += H;   // add H value every time
```

```
* ** * ** ** * ** * ** * ** ** * ** * ** * ** * ** ** * ** * ** * ** ** * ** * *
* * ** ** * ** * ** * ** * ** ** * ** * ** * ** ** * ** * ** * ** ** * ** * ** *
 ** ** * ** * ** * ** * ** ** * ** * ** * ** ** * ** * ** * ** ** * ** * ** * **
 ** * ** * ** * ** * ** ** * ** * ** * ** ** * ** * ** * ** ** * ** * ** * ** **
 * ** * ** * ** * ** ** * ** * ** * ** ** * ** * ** * ** ** * ** * ** * ** * **
** * ** * ** * ** ** * ** * ** * ** ** * ** * ** * ** ** * ** * ** * ** * ** **
* ** * ** * ** ** * ** * ** * ** ** * ** * ** * ** ** * ** * ** * ** * ** ** * *
* * ** * ** ** * ** * ** * ** ** * ** * ** * ** ** * ** * ** * ** * ** ** * ** *
 ** * ** ** * ** * ** * ** ** * ** * ** * ** ** * ** * ** * ** * ** ** * ** * **
 * ** ** * ** * ** * ** ** * ** * ** * ** ** * ** * ** * ** * ** ** * ** * **
** ** * ** * ** * ** ** * ** * ** * ** ** * ** * ** * ** * ** ** * ** * **
** * ** * ** * ** ** * ** * ** * ** ** * ** * ** * ** * ** ** * ** * * *
* ** * ** * ** * ** * H=20000 ontime=40000 offtime=25536 i=65536

**** ***** **** ***** ***** **** ***** ***** **** ***** ***** ***** **** ***** *
**** **** ***** ***** **** ***** ***** **** ***** ***** **** ***** ***** **** **
*** ***** **** ***** ***** ***** **** ***** ***** **** ***** ***** **** ***** **
*** **** ***** ***** **** ***** ***** **** ***** ***** **** ***** ***** ***** **
** ***** ***** **** ***** ***** **** ***** ***** **** ***** ***** **** ***** ***
** **** ***** ***** **** ***** ***** **** ***** ***** ***** **** ***** ***** ***
* ***** ***** **** ***** ***** **** ***** ***** **** ***** ***** **** ***** ****
* **** ***** ***** ***** **** ***** ***** **** ***** ***** **** ***** ***** ****
 ***** ***** **** ***** ***** **** ***** ***** **** ***** ***** **** ***** *****
 ***** **** ***** ***** **** ***** ***** **** ***** ***** **** ***** ***** ****
***** ***** **** ***** ***** **** ***** ***** ***** **** ***** ***** **** ***** *****
**** ***** ***** **** ***** ***** **** ***** ***** **** ***** ***** **** *
**** ***** ***** H=27000 ontime=54000 offtime=11536 i=65536
```

*FIG. 8*

```
short int H, acc;

H=27000;
acc  =  H;
for(i=0;i<65536;++i)
{
        if(acc  &  0x8000)
        {
                ++offtime;    //sign bit set   MSB = sign bit
                printf("  ");
        }
        else
        {
                ++ontime;
                printf("*");
        }
        acc   |=  0x8000;  //set sign bit every time
        acc  +=  H;   // add H value every time
```

*FIG. 9*

H = 32768 = 100% On,
H = 0 = 100% Off

CASCADE LED DRIVER AND CONTROL METHODS

FIELD OF THE INVENTION

Various of the disclosed embodiments concern systems and methods for implementing and operating a diode system and circuit, such as a light emitting diode (LED).

BACKGROUND

A light-emitting diode (LED) is a semiconductor diode that emits incoherent narrow-spectrum light when electrically biased in the forward direction of the p-n junction. LEDs typically produce more light per watt than incandescent bulbs. LEDs are often used in battery powered or energy saving devices, and are becoming increasingly popular in higher power applications such as, for example, flashlights, area lighting, and regular household light sources.

A primary consideration with the use of LEDs in higher-power applications is the quality of delivered light. High brightness white LEDs tend to have high spectral peaks at certain wavelengths. The Color Rendering Index (CRI) is a measure of how true the light is as compared to an ideal or natural light source in representing the entire light spectrum. An ideal or natural light source has a high CRI of, for example, 100. White LEDs typically have a poor CRI, in the approximate range of 70-80, because of their spectral concentration. To solve this problem with white LEDs, a preferred approach has been to mix the light from different-colored LEDs to better fill out the light spectrum. For example, combinations of white, amber, red, and green can provide CRIs at or above 90. These combinations can also provide for color temperature control without adding efficiency-eroding phosphors to LEDs.

Combinations of different-colored LEDs may include color strings of same-colored LEDs. There are two conventional approaches for modulating the light output from each string of same-colored LEDs. The first approach is to directly modulate the current source to each string, which in turn varies the amplitude of each string's output. The second approach is to provide a constant current source and turn the string of LEDs on and off over a particular duty cycle to change the perceived light intensity of that string. These approaches are used not only to change the relative intensity of each color but also to raise and lower the overall intensity of the string in a manner similar to a dimming function. While these approaches provide complete color control, they both have significant efficiency penalties.

With the current-modulating first approach, LEDs are regulated, for example with a Buck regulator, from a common bus voltage source that meters a regulated current to each string. The bus voltage is sized to the longest string by adding up the voltage drop across each LED. Consequently, the shorter strings are penalized by having to regulate the current with a disproportionately greater voltage drop. With multiple different-color LED strings being utilized in the first approach to provide a high CRI value, the overall efficiency penalty can be high. For example, in an application having a string of 5 white LEDs, a string with one green LED, and a string with one red LED, the voltage drop across the white LEDs will add up to approximately 15 volts, but the red and green LED strings will be regulated to 3 volts. Regulating a 15 Volt string from a 15V bus would be very efficient, but regulating the other strings to 3 volts would be quite inefficient. This situation becomes worse when considering that the mains (AC input) needs to be regulated from 120 VAC or 270 VAC down to the bus voltage. Typically, the bus would be sized to about 30 VDC to allow for reasonable efficiency converting from the mains to the DC bus, making even the longest string less efficient.

The duty-cycling second approach uses a constant current source for each LED string and modulates ("blink") the duty cycle of the LED string itself at a rate imperceptible to the human eye. This allows for a simple current regulator, such as an LM317, but it must still regulate down to match the lower LED string requirements, which is inefficient. Furthermore, running the LEDs at their full current rating and duty cycling their outputs is far less efficient than simply running the LEDs continuously at a lower current, because LED efficiency declines with increasing current output.

The foregoing examples of the related art and limitations related therewith are intended to be illustrative and not exclusive. Other limitations of the related art will become apparent upon a reading of the specification and a study of the drawings.

BRIEF DESCRIPTION OF THE DRAWINGS

One or more embodiments of the present disclosure are illustrated by way of example and not limitation in the figures of the accompanying drawings, in which like references indicate similar elements.

FIG. 8 is a depiction of pseudocode and a corresponding output for a simulation of the driving behavior of the circuit element, such as the circuit element of FIG. 1, in certain embodiments.

FIG. 9 is an enlarged view of the pseudocode depicted in FIG. 8.

DETAILED DESCRIPTION

The following description and drawings are illustrative and are not to be construed as limiting. Numerous specific details are described to provide a thorough understanding of the variously disclosed concepts.

Circuit Element Overview

Figure 1:
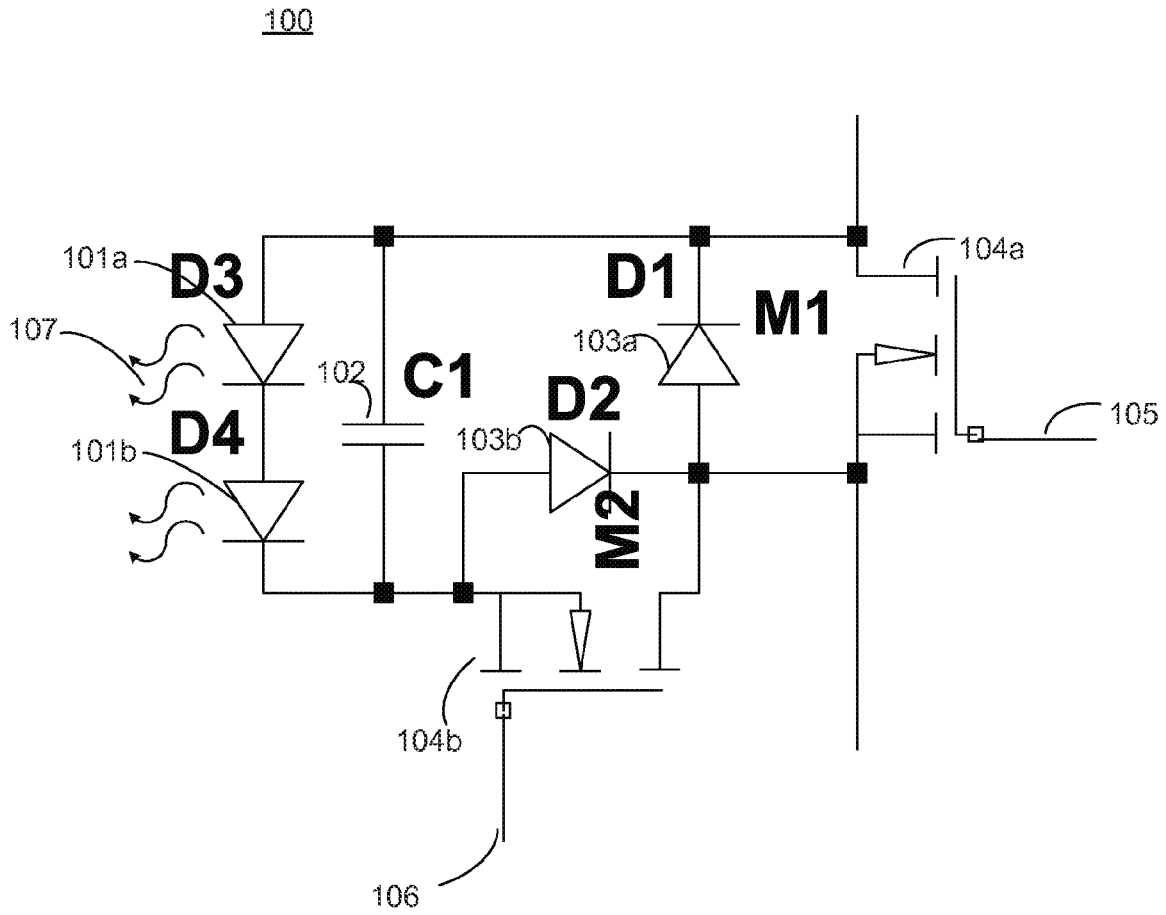
FIG. 1 illustrates a circuit elements as may be used in certain embodiments to drive a diode, such as an LED.

FIG. 1 illustrates a circuit element 100 as may be used in certain embodiments to drive a diode 101*a*, 101*b*, 103*a* or 103*b*, such as an LED, or a plurality of output diodes 101*a-b* or 103*a-b*, such as LEDs.

The capacitor 102 may be a small ceramic cap for switching frequencies that can be readily realized. Switches 104*a* and 104*b* may be power mosfets, BJTs, etc. and, in some embodiments, may have voltage ratings matching their respective string voltages. The switches may not need to be able to block the entire cascade voltage. In some embodiments, low voltage, high-current low-cost mosfets that match their respective LED sub-string voltages may be used throughout.

In some embodiments the switches 104*a-b* are coupled with one or more digitally-timed waveform signals. If waveform timings are precisely known, then the ratios of current to each string may be precisely known in some embodiments. The proposed "waveform generator" discussed in greater detail below, may be a digital-based algorithm that will achieve precise "quanta" of delivered current.

Figure 2:
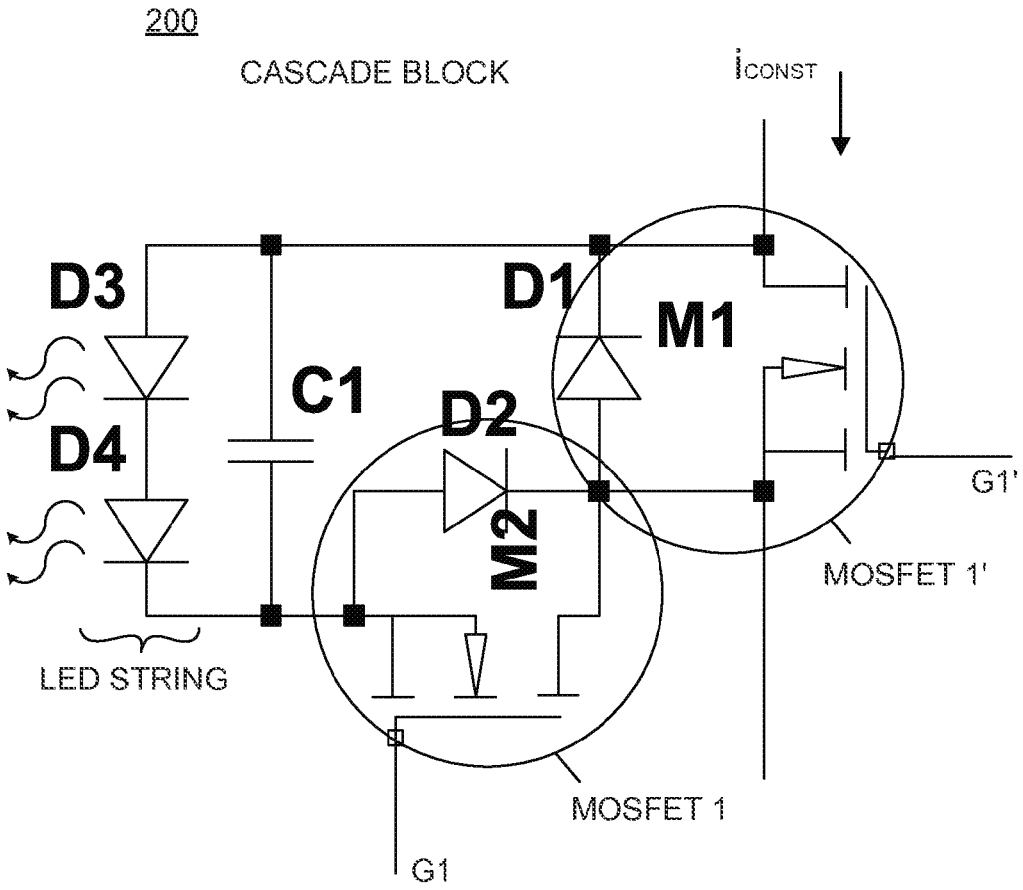
FIG. 2 illustrates the circuit element of FIG. 1 including various connection indications as implemented in certain embodiments for driving one or more LEDs.

FIG. 2 illustrates a circuit element 200 (e.g., the circuit element of FIG. 1) including various connection indications as implemented in certain embodiments for driving one or more LEDs. G1 may be a gate drive 106 (ON here in this example may be the same as ON time for the LED). G1' is gate drive 105 (ON here, FET conducting) that may be active when current is NOT going to LED. G1 and G1' are in some embodiments complementary (one on and other off always).

C1 may be a ceramic capacitor that supplies LED current during OFF portion of cycle. D3 and D4 are representative light-emitting diodes that emit light 107 (may be 1 or more LEDs).

D1 and D2 may be intrinsic diodes in most power mosfets (comes with the MOSFET embedded in same package).

M2 may be conducting when LED current supply duty cycle is ON and M1 may be the converse.

Circuit Element Combinations

Figure 3:
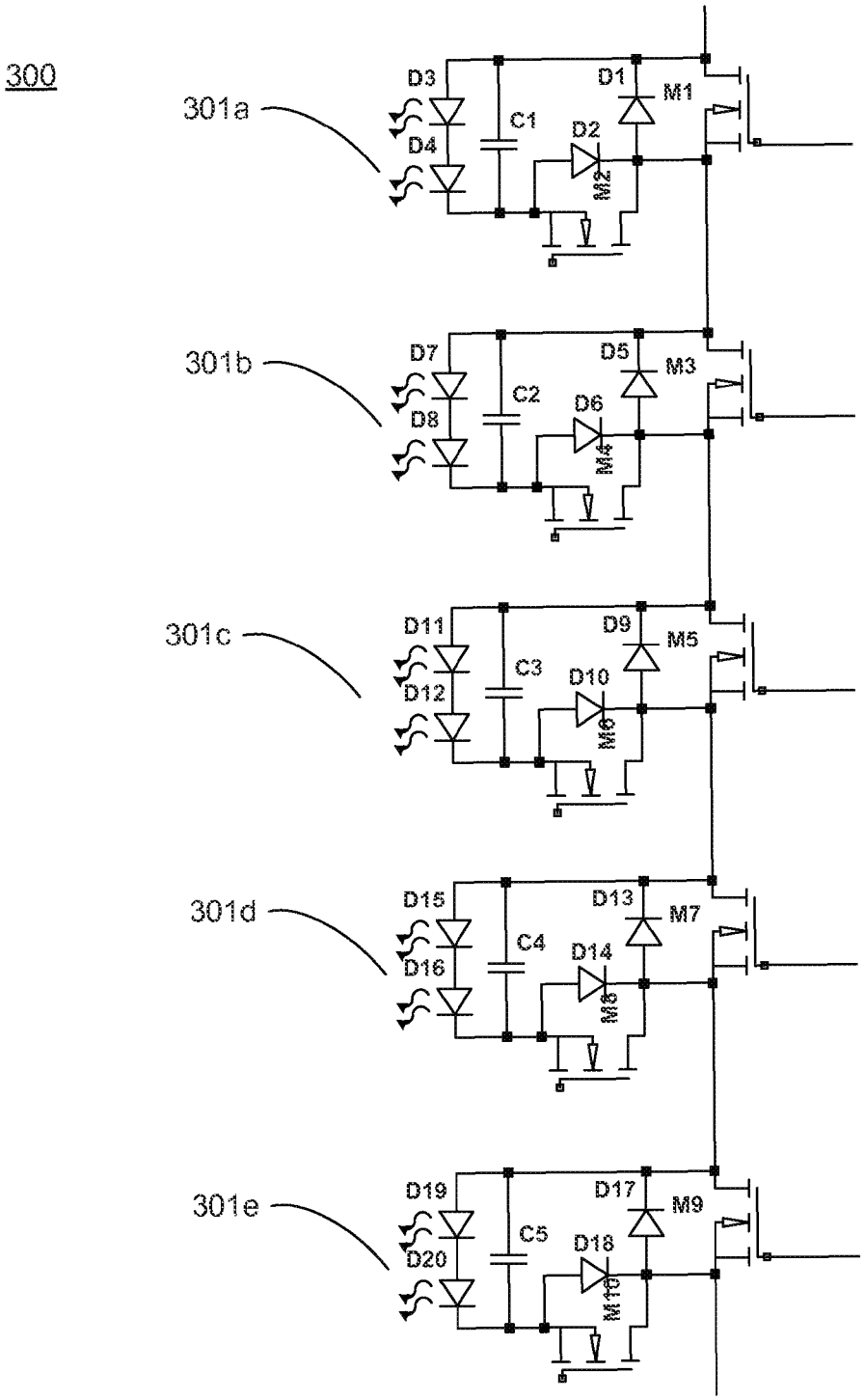
FIG. 3 illustrates a diagram of a plurality of circuit elements placed in series so as to implement various features of certain embodiments.

FIG. 3 illustrates a diagram 300 of a plurality of circuit elements 301 *a-e* placed in series so as to implement various features of certain embodiments.

The illustrated 5 substring (5-color LED system) is an example of one possible cascade. The strings shown may have 2 LEDs, but more there may be different LED counts in each, possibly with different current ratings.

Various of the disclosed embodiments anticipate current rating behavior in the circuit. With a current PWM it may sometimes arise that the system will be out-of-spec overdriving some of the LED strings. With certain of the disclosed embodiments the system can have "lower power" LEDs co-exist in series with higher power LEDs.

A 5 color system may be common for high-fidelity color rendering—spectrally it may consist of red, blue, yellow-greenish, cyan, and possibly red-orange—and other combinations that routinely end up being 5 distinct color components to achieve a high-fidelity tunable white.

Figure 4:
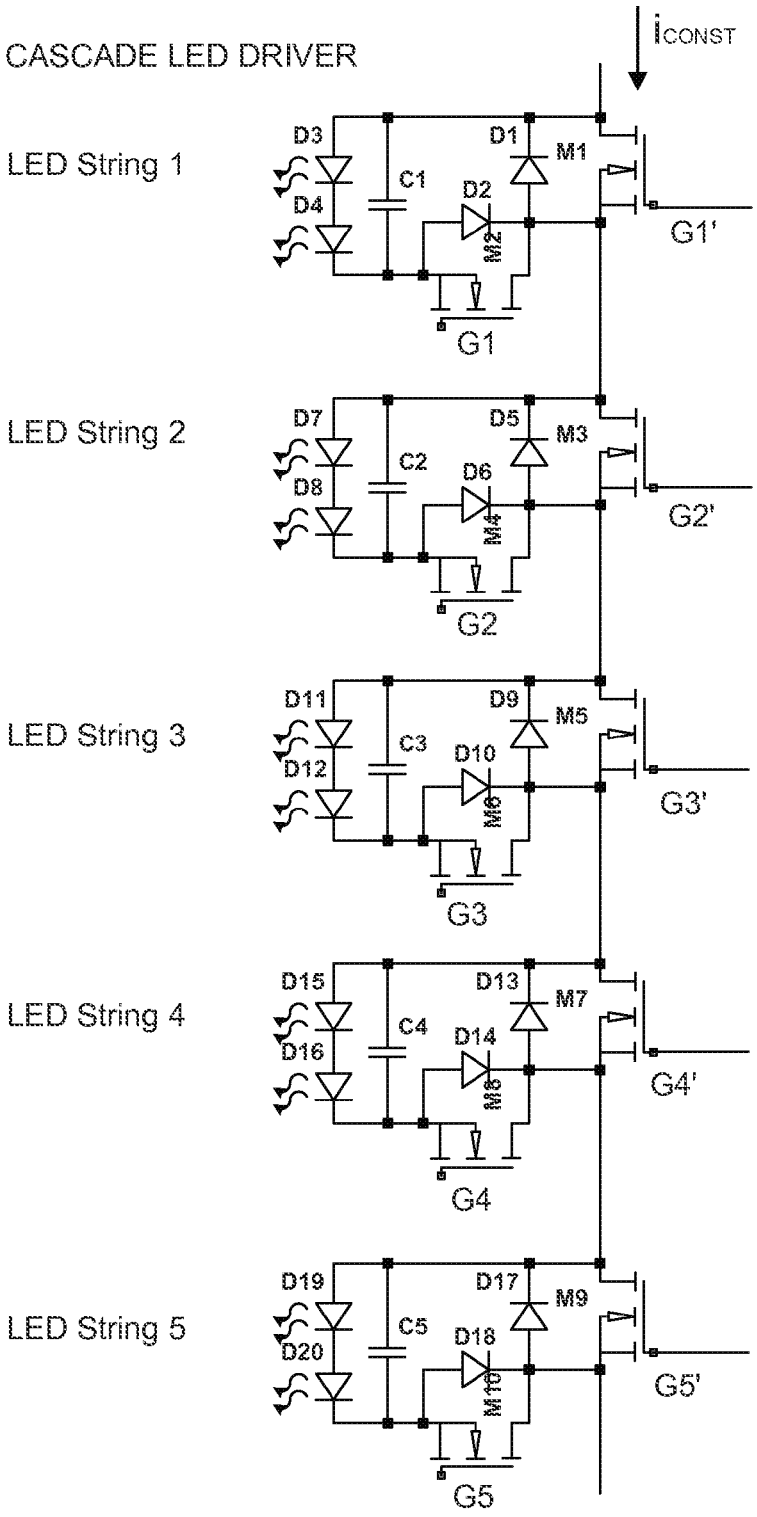
FIG. 4 illustrates the diagram of FIG. 3 including various connection indications as implemented in certain embodiments for driving one or more LEDs.
Figure 5:
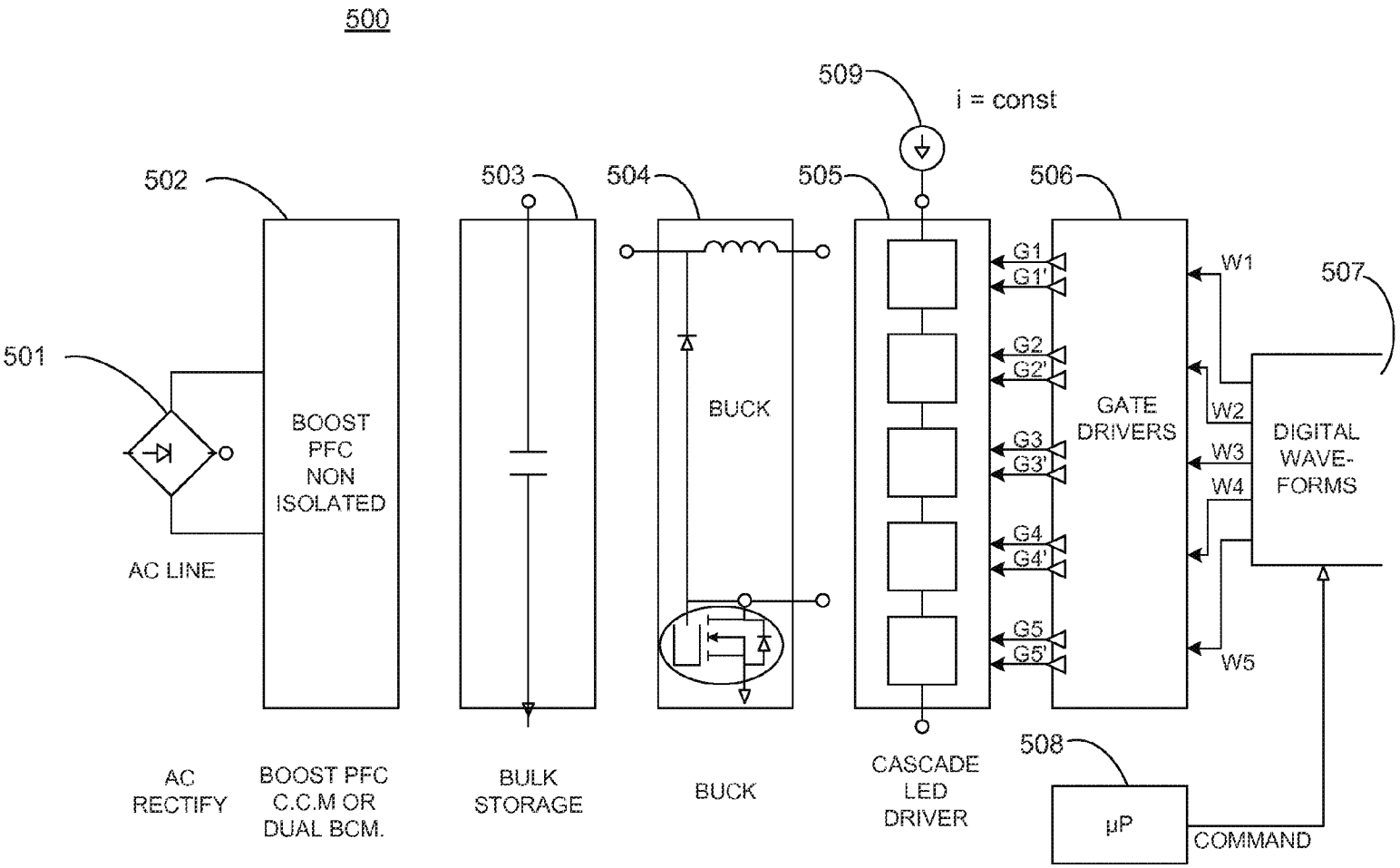
FIG. 5 illustrates a generalized block level circuit diagram for connecting various components in conjunction with one or more circuit elements, such as the circuit element depicted in FIG. 1.

FIG. 4 illustrates a diagram of a plurality of circuit elements placed in series so as to implement various features of certain embodiments System Implementation of Circuit Element FIG. 5 illustrates a generalized block level circuit diagram 500 for connecting various components in conjunction with one or more circuit elements, such as the circuit element depicted in FIG. 1. The microprocessor 508 may be used to perform various operations disclosed herein. Digital waveform generator 507 may be an EEPROM. Yes, most microprocessors have some on-board, but in some lamp forms, there may be advantage to externalize the memory and fix it to the lamp/LED system. This would allow the same driver/controller to accept new LED "bulbs"—each "bulb" having a $0.10 serial EEPROM on board that identifies it and stores the unique color model of the LEDs of that lamp and all the life/usage statistics/histogram.

The circuit of FIG. 5 may depict AC line voltage powered circuit 501. Each of the elements are shown separately in a line for purposes of explanation, but one will recognize that they may be electronically in communication in parallel. In some embodiments the boost PFC 502 may provide a low-emf (continuous current after modest EMI filter), high-power factor draw from AC line. Depending on size/power—either a continuous conduction or boundary conduction (possible dual 180 degree out-of-phase boost stages) may be employed. In some embodiments, SiC rectifiers may be employed depending upon overall cost and efficiency trade-offs.

A method for integrated lamp may be "NON-isolated"—substantially higher system efficiency may be possible. In some embodiments, a requirement for electrical isolation of LEDs from thermal heat-sinking paths may be imposed. The Voltage may be boosted to 170-200 V (120V, single-phase).

The bulk storage capacitor 503 may provide continuous power to the continuously-lit LED cascade string. AC power may come in 120 half-cycle "buckets" when voltage is non-zero. A bulk storage capacitor 503 may provide energy in between in some embodiments. The bulk storage capacitor 503 may fundamentally have voltage ripple. In some embodiments, this voltage ripple is allowed to be non-trivial so as to in-turn minimize the size of bulk storage capacitor 503 and cost (limited to "ripple current" self-heating limitations of the capacitor). The BUCK stage 504 may provide constant current to cascade circuit, even though cascade total voltage will "step" up and down depending on which strings are active. If the Buck stage has low-inductance, it may quickly respond, e.g. by an associated instantaneous voltage delta across the buck stage inductor.

as total led counts are growing—from 10 to now upwards of 20 to 30, cascade string voltage are approaching 60-90V—ideal for direct AC applications (with direct non-isolated AC power supplies) (more than the 10-LED 30V noted)

d

The Buck stage may have a single current sensor that determines lamp overall current (dominant substring current—one string runs at 100% duty cycle—as color point or CCT changes, other strings may become dominant).

The Cascade Circuit element 505 may consist of a series of sub-units as discussed herein.

Gate Drivers 506 may comprise High-side NMOS mosfet drivers. One will recognize a variety of methods to implement from either discrete elements or integrated high voltage device. In some embodiments, drivers are in synchronous complementary pairs—one pair for each LED string.

The digital waveform generator may be a digital device that works side-by-side with microcontroller. Function may be extended to controlling both waveforms for the BOOST PFC and the BUCK mosfet switches.

The Microprocessor may send commands to the waveform generator to control LED strings. A Command may consist of a set of 16-bit numbers—one for each LED string—that determines the current that string will actually receive (after signals from waveform generator drive the circuit).

The Microprocessor may also readily observe AC line for "dimming signal" (from wide variety of dimmer switches) and calc equivalent LED brightness commands, as well as generate waveform commands for both the PFC Boost and Buck stages. A/D converter of uP would observe necessary voltages/currents on system.

An EEPROM—(Not shown in FIG. 5) may store a "Color model"—tables of ratios of LED currents at different color points, temperatures and brightness levels.

The I/O interface—not shown—may receive light control signals—(DMX, DALI, 0-10V, etc. . . . ).

An RF Unit—not shown—may receive RF command signals and feedback (Zigbee, Ultra-Wideband, WiFI, etc. . . . )

Circuit Element Driving Mechanisms

Figure 6:
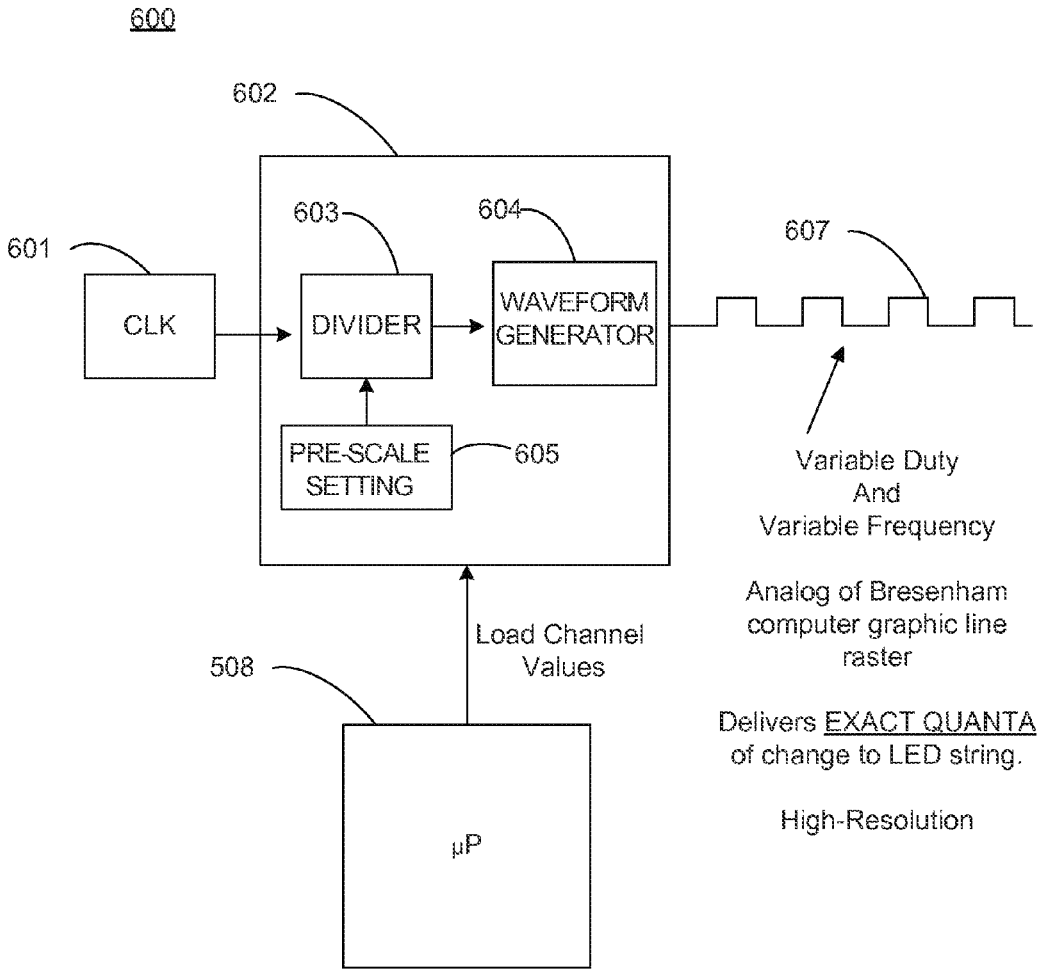
FIG. 6 illustrates a generalized block level diagram of the waveform generator as may be implemented in certain embodiments to drive the circuit element, such as the circuit element of FIG. 1.

FIG. 6 illustrates a generalized block level diagram of the waveform generator 600 as may be implemented in certain embodiments to drive the circuit element, such as the circuit element of FIG. 1. The following references apply to the depicted example:

601—input clock—for LED purposes, can be a modest 10-20 MHz and achieve exceptional levels of precision of LED current control. 605—is a register value that sets a divider (which stage in a series of CLK/2, CLK/4, CLK/8 . . . )—that "slows down" the frequency of the waveforms generated. 603—divider (CLK/2, CLK/4, . . . 604—waveform generation digital circuit—may consist of 16-bit register storing "H" value, 16-bit accumulator capable of adding "H" to it. Sign bit may be most significant bit MSB and its state and manipulation of it (in some embodiments along with repeated additions of H to ACC control the progression of the waveform. 607—waveform—variable freq, variable duty cycle (good for "spread spectrum" electrical noise and minimizing "beat" phenomenon.

Figure 7:
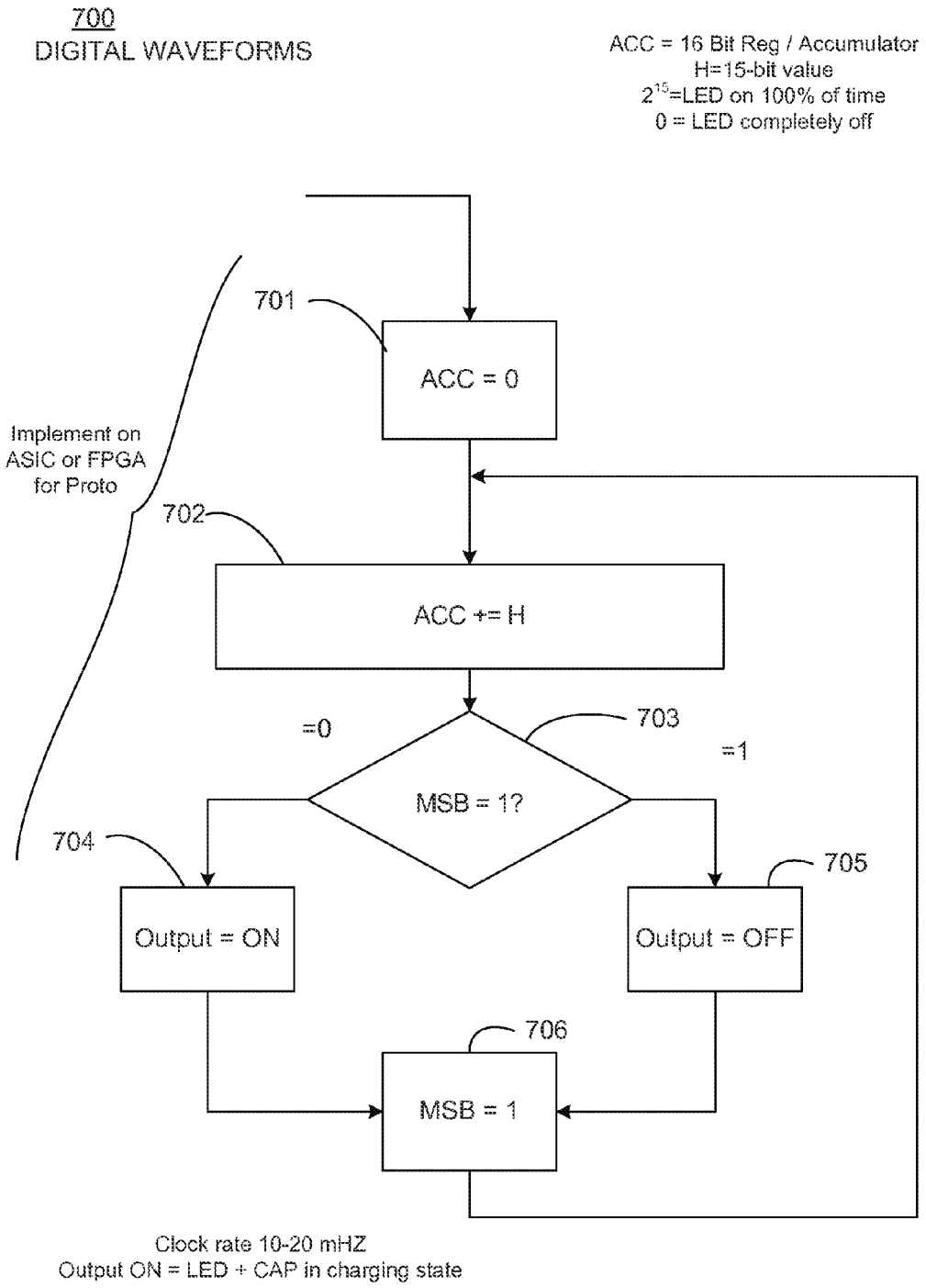
FIG. 7 illustrates a generalized process flow diagram for driving the circuit element, such as the circuit element of FIG. 1.

FIG. 7 illustrates a generalized process 700 flow diagram for driving the circuit element, such as the circuit element of FIG. 1.

In some embodiments, the depicted algorithm may be a raster algorithm adapted to a variable-duty cycle, variable frequency waveform that yields a precise cumulative on-time for each sub string. The waveform produced may uniquely have favorable on and off cycle periods (not too short, not too long) across a broad range. In some embodiments a clock-pre-scaler may be combined with the circuit.

The result may be precise control of total "quanta" of current (actually simply total charge delivered)—rather than "PWM" or "Duty cycle" etc. using the unique generated waveform.

In some embodiments the procedure may proceed as follows: Supply a value for "H" to a register (step 701). An accumulator then begins a "mid-point algorithm" that with successive subtractions and additions (and tricks of integer roll-over_ yields on "on time" that is exactly equal to the value of H (steps 702 and 703)—spread as uniformly as possible over the time period for the quantization (time steps) used.

In some embodiments, the algorithm may parallel the drawing of a line on a computer screen. It may step to the left and upward progressively in a manner that gives the straightest-appearing line for the pixel-resolution of your screen.

The horizontal x-axis may be a time-scale in this hypothetical, each pixel being a clock cycle. The y-axis may in turn (for a diagonally upward-sloping line) represent that each pixel movement upward at a period of time is that the output is "ON" (step 704). For example, a 45 degree upward (slop =1:1) line would be on (one step upward) for each and every "time" step lateral. For lesser slopes between 0 and 1:1, there may not be a step upward for each and every time step. Periodically, no step may occur—that time period is comparable to an "off" cycle (step 705). The pattern may not be equally-spaced, but it may average out exactly right over the span of the whole line—this is what the "Quantization algorithm" or the LED on-time control may do in some systems (step 706). In some embodiments, it may not be defined by a "pulse width" nor is the LED blinking due to the novel circuit allowing it to run continuously and arbitrary precise current levels.

Circuit Element Driving Mechanisms—Pseudocode Implementation

FIG. 8 is a depiction of pseudocode and a corresponding output for a simulation of the driving behavior of the circuit element, such as the circuit element of FIG. 1, in certain embodiments.

FIG. 9 is an enlarged view of the pseudocode depicted in FIG. 8

Figure 10:
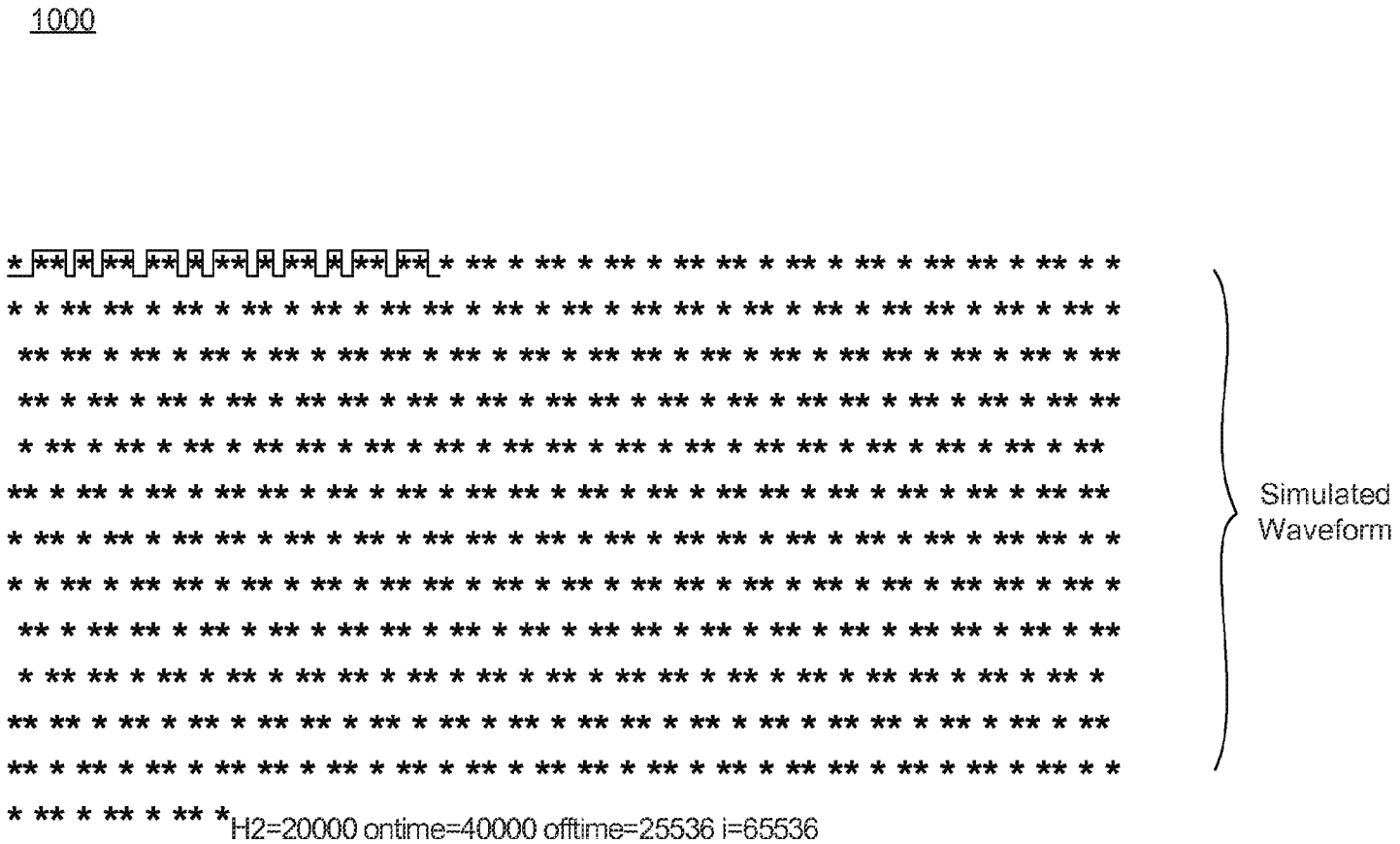
FIG. 10 is an enlarged view of the first output at a first H value depicted in FIG. 8.
Figure 11:
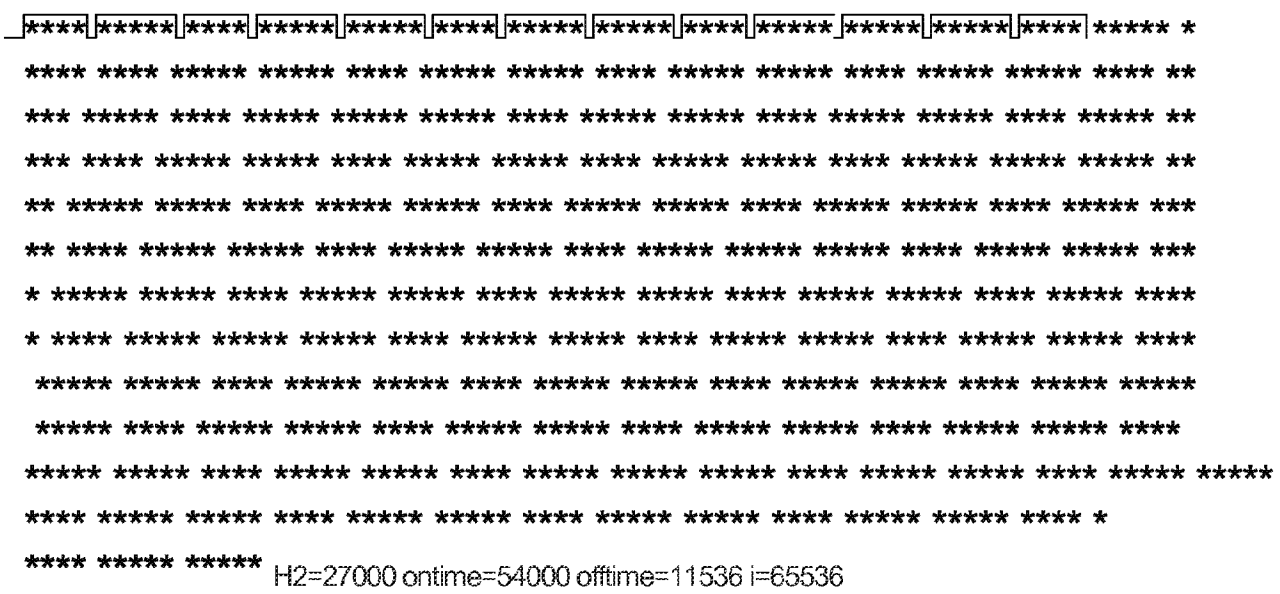
FIG. 11 is an enlarged view of the second output at a second H value depicted in FIG. 8.

FIG. 10 is an enlarged view of the first output at a first H value depicted in FIG. 8. In FIGS. 10 and 11 a "*" may indicate a positive control input to the switches of the circuit FIG. 11 is an enlarged view of the second output at a second H value depicted in FIG. 8.

Cascade Circuit

As discussed variously herein, in some embodiments, the cascade circuit may consist of a plurality of sub-units. Each sub unit may consist of: 2 power FETS (typically NMOS power FETs, but not limited to) Pair works in opposition—when one is off the other is on; A ceramic capacitor; a String of LEDs.

The LED string length may be different from sub-unit to sub-unit (e.g. for color-mixing, more yellow-green phosphor pumped leds may be necessary and only 1 or 2 LEDs for Cyan or Red or Blue portions of the spectrum to be reconstructed.). In some embodiments, power Mosfets may be sized to their specific substring—allowing for cost and efficiency optimization within each string (some cascade circuits will be sized with higher-voltage switches—switches that would have higher on-resistance, gate charge, etc. . . . and greater losses during on/off pinch time due to greater I*V product).

In some embodiments, sub-units may be arbitrarily stacked (e.g. 3 LED strings, 4 strings, 7 strings, etc. . . . ).

Operation

Cascade blocks may be connected in series. By so doing, the supply current to the LED array may be limited to the equivalent of one LED, and at one voltage (at a given moment in time). In contrast, some systems using parallel dissimilar string would require multiple string voltages, each with multiple currents, some voltages very low (single LED) and others typically 3-5×higher.

Operation—Cascade Constant Current Supply

The Cascade (consisting of multiple series-connected LED string driver blocks)—may be supplied with a constant current source (typically a buck controller with a low-capacitance output (so voltage quickly follows the stacked cascade voltage at any given moment in time).

Current Bypasses LED/Cap Pair or Else Passes Through it

The constant current may either be shunted by a conducting transistor 104*a* M1, while the LED substring is able to continue to be illuminated while powered by a decaying voltage/current from its associated capacitor, or the constant current is blocked by 104*a* M1 and conducted by transistor 104*b* M2 and passes largely though the capacitor 102. For the currents and voltages and realizable switching frequencies, very low-cost reasonably-sized ceramic capacitors may exist for the task. The LED current may defined by the voltage across the LED or plurality of LEDs 101*a-b*, which may be equal to the capacitor 102 voltage. When the current passes through transistor 104*b* M2, LED current may be relatively constant (slowly rising with the rising voltage of the capacitor 102). The capacitor 102 may receive the bulk of the current and its voltage may rise accordingly and modestly before it is disconnected from the supply current and begins to discharge current to the LEDs 101*a-b* at the LED's current operating state.

Operation—LED Operating State

The LED substrings 101*a-b* may operate at continuous voltage and current that is proportional to the average on-time of M2*I_supply. Constant Current operation may be advantageous because LED efficacy rises with reduced relative current. Typical efficacy (Lumens per watt) can vary by a factor of 2:1 for 20% versus 100% load. In contrast, operating LEDs in PWM mode, with a current set to the max current demand among the strings, may result in all other strings operating at less than 100% duty cycle to operate at significantly reduced efficacy.

Switching frequency may be sufficiently high (though may be variable) to ensure that current ripple through the LEDs is sufficiently small.

Operation—LED Current Ratios

Precise color mixing of multiple LED substrings may be achieved when precise control of the current through each string is achieved. In certain embodiments of the disclosed driver system, each respective LED string may operate in continuous mode at unique fractional currents (relative to I_supply current) in a near lossless manner.

Fractional current may be a precise function of total string on-time (when supply current moving across LED string) and supply current). Relative (string-to-string) current may be a precise function of each respective string's average on-time. For example, typically a "primary" string will be running at 100% duty cycle (so it's current=I_supply, say 1.0 A), and in turn each respective string with average % on-time of 45%, 57%, 82%, 22%—will experience precisely I_supply*% on time, so 450 mA, 570 mA, 820 mA, 220 mA respectively.

Any variation or error in the I_supply current may be multiplied across all the strings, so the ratio of currents to each string (and associated light) may be relatively unchanged.

Operation—Current Sensing

In some embodiments, only one current sense is necessary—the I_supply current to the LEDs. This may be sensed on the low-side in a relatively non-dynamic manner. In some embodiments, it may be sensed across a low-side FET, etc. In some embodiments, it may not be necessary even require a sense resistor. In some embodiments, the precision of this device can be relatively low (compared to the precision necessary to maintain tight color point control of a spectrally-mixed light source).

Typical LED multi-string systems may require separate current sensors for each and every string. Furthermore, if the strings are arranged in any cascaded manner, the current sensors may need to be floating on the high side and possibly undergoing dynamic voltage changes to ground—all which may be challenges to stable current sensing in some embodiments. Correcting this situation may add complexity to achieve desired precision.

In contrast, in some embodiments, all current sensing of individual strings may be eliminated, while still being able to have precise variable continuous (non PWM, blinking LEDs) current to each LED.

Operation—Form of Timing

Digital timing of the waveforms may be preferred due to the potential for very exact ratios of average on-time.

Challenges of digital timing—in some embodiments, the duty cycle at each LED must be short to minimize the size of ceramic capacitors. The average switching frequencies from 100 to as high as 1000 KHz may be desired. Attempting to generate PWM waveforms with sufficient fine-ness may be challenging. Furthermore, with low duty cycle states, stand PWM solutions may yield on-times distorted substantially by the rise and fall times of the MOSFET. For example, a 500 KHz waveform, with 1/1000 resolution with a "PWM" type circuit, may require a PWM clock rate of 1000*500 KHz=500 MHz. For low duty cycle levels—say 1%—the PWM on-time would be only 20 ns.

Operation—Novel Waveform Generator for Cascade/Ratiometric Systems

It may be possible to have a digital waveform that has a precisely accumulated on-time, while also spreading out frequency and duty cycle (continuously varying both frequency and duty cycle).

A digital waveform generator is contemplated in certain embodiments—consisting of a 16-bit clock, 15-bit "on-time fraction" register, and an integer algorithm to generate a precise waveform with an exact known duty cycle. The algorithm may be related to the "Bresenham" type computer raster algorithms.

The generator may be controlled for a supervisory microcontroller unit that provides it exact ratios.

In some embodiments the system may include:

10 to 20 Mhz base clock;

Input clock pre-scaler (allows the frequency of the cycle to be set depending on load levels);

Implemented on a 16-bit counter+adder (MSB is sign bit);

0 to 2^15 count representing 0 to 100% average of the cascade circuit supply current;

Waveform is variable duty cycle, but at end of cycle, total on-time will be exactly equal to programmed ratio;

Full Cycle completes every 2^15 clock cycles and repeats. For a 10 MHz clock, cycle repeats at over 300 Hz—well beyond eye perception for both cones and rods. The cycle may be highly averaged over entire period—so variation within the 1/300 Hz period may also be small.

Additional Systems and Integration

The opportunity may exist to use a low-cost microcontroller to observe AC supply. The LED lamp system may consist of: AC to DC conversion (AC "dimming" recognition); AC PFC Boost-Either continuous conduction mode, Critical conduction, Dual boundary conduction (180 degrees out of phase); and DC Buck supplying constant current to the LEDs.

Some systems may have DC supply, but the Boost stage may still be desired in some embodiments in order to accommodate a range of DC supply voltages both below and above that of the full cascade string voltage.

Boost Capacitor Size Minimization—by increasing the ripple current (and voltage swing) on the PFC boost capacitor (on a single-phase AC supplied system)—a much smaller bulk bus capacitor may be realized that operates still well within its ripple current limitations (over expected life and beyond as cap decays). Achieving this level of control may be best/most readily accomplished by digital means.

AC waveforms may be relatively slow compared to digital supervisory capabilities of the most basic microcontrollers. "Decoding" of "incandescent-equivalent" dimming for a wide variety of AC dimmer switch units may be problematic in some forms except digital.

Expanded Application of Waveform Generator/Microcontroller

Various embodiments contemplate a system having a low-cost microcontroller 508 to observe AC supply, Boost Bulk Capacitor state, and Buck state (with exact observer knowledge of Cascade Circuit Loading/Timings)—to integrate additional channels of waveform generator to handle both PFC boost, and buck subsystems (eliminating need for separate PFC controller and separate buck controller).

Remarks

The description and drawings are illustrative and are not to be construed as limiting. Numerous specific details are described to provide a thorough understanding of the disclosure. However, in certain instances, well-known details are not described in order to avoid obscuring the description. References to one or an embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any term discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given above. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions will control.

The words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The foregoing description of various embodiments of the claimed subject matter has been provided for the purposes of illustration and description. It is not intended to be exhaustive or to limit the claimed subject matter to the precise forms disclosed. Many modifications and variations will be apparent to the practitioner skilled in the art. Embodiments were chosen and described in order to best describe the principles of the invention and its practical application, thereby enabling others skilled in the relevant art to understand the claimed subject matter, the various embodiments and with various modifications that are suited to the particular use contemplated.

The teachings of the invention provided herein can be applied to other systems, not necessarily the system described above. The elements and acts of the various embodiments described above can be combined to provide further embodiments.

While the above description describes certain embodiments of the invention, and describes the best mode contemplated, no matter how detailed the above appears in text, the invention can be practiced in many ways. Details of the system may vary considerably in its implementation details, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

What is claimed is:

1. A device for controlling a circuit in communication with a plurality of light emitting elements, the device comprising:

a clock to generate a cyclic signal at a clock frequency;

a divider to slow down the cyclic signal;

a register configured to store a stored value;

an accumulator configured to store an accumulator value;

a plurality of drivers for the plurality of light emitting elements; and a waveform generator configured to generate a digital waveform based on successive additions of the stored value to the accumulator value, wherein the digital waveform is provided to the plurality of drivers corresponding to the plurality of light emitting elements; and wherein each driver of the plurality of drivers includes:

a gate driver configured to receive a respective digital waveform from the waveform generator;

a cascade driver coupled to the gate driver, wherein the cascade driver includes at least a capacitor;

wherein the cascade driver provides continuous electrical current to a corresponding light emitting element of the plurality of light emitting elements at a respective current ratio dictated by the respective digital waveform.

2. The device of claim 1, wherein the waveform generator is configured to generate a variable frequency waveform.

3. The device of claim 1, wherein the waveform generator is configured to generate the waveform based in part on a single bit of the accumulator value.

4. The device of claim 3, wherein the single bit is the most significant bit of the accumulator value.

5. The device of claim 1, further comprising a microprocessor configured to determine the stored value.

6. The device of claim 5, wherein the waveform generator comprises an EEPROM.

7. The device of claim 1, wherein the waveform generator is in electrical communication with an input of a circuit, the circuit comprising a first diode comprising a cathode terminal and an anode terminal;

a second diode comprising a cathode terminal and an anode terminal;

a first switch comprising a first terminal and a second terminal;

a second switch comprising a first terminal and a second terminal;

a capacitor comprising a first terminal and a second terminal;

a first output terminal; and a second output terminal, wherein the cathode terminal of the first diode is in electrical communication with the first output terminals, the cathode terminal of the second diode is in electrical communication with the anode terminal of the first diode, and the first terminal of the capacitor is in electrical communication with the cathode terminal of the first diode and the second terminal of the capacitor is in electrical communication with the anode terminal of the second diode.

8. A device for controlling a circuit in communication with a plurality of light emitting elements, the device comprising:

a clock to generate a cyclic signal at a clock frequency;

a divider to slow down the cyclic signal;

a register configured to store a stored value;

an accumulator configured to store an accumulator value; and a waveform generator configured to generate a digital waveform based on successive additions of the stored value to the accumulator value, wherein the digital waveform is provided to a plurality of drivers corresponding to the plurality of light emitting elements;

wherein the waveform generator is in electrical communication with an input of a circuit, the circuit comprising a first diode comprising a cathode terminal and an anode terminal;

a second diode comprising a cathode terminal and an anode terminal;

a first switch comprising a first terminal and a second terminal;

a second switch comprising a first terminal and a second terminal;

a capacitor comprising a first terminal and a second terminal;

a first output terminal; and a second output terminal, wherein the cathode terminal of the first diode is in electrical communication with the first output terminal, the cathode terminal of the second diode is in electrical communication with the anode terminal of the first diode, and the first terminal of the capacitor is in electrical communication with the cathode terminal of the first diode and the second terminal of the capacitor is in electrical communication with the anode terminal of the second diode.

9. A device for controlling a circuit in communication with a plurality of light emitting elements, the device comprising:

a clock to generate a cyclic signal at a clock frequency;

a divider to slow down the cyclic signal;

a register configured to store a stored value;

an accumulator configured to store an accumulator value;

a waveform generator coupled to the accumulator and configured to generate a digital waveform based on successive additions of the stored value to an accumulator value; and a plurality of drivers respectively coupled to the plurality of light emitting elements, wherein each driver of the plurality of drivers includes at least a first transistor, a second transistor, and a capacitor, wherein at least one of the first transistor and the second transistor is configured to be on when the circuit is active such that continuous electrical current is provided to a corresponding light-emitting element when the circuit is active.

* * * * *